US006770314B1

(12) United States Patent
Scott et al.

(10) Patent No.: US 6,770,314 B1
(45) Date of Patent: Aug. 3, 2004

(54) METHOD FOR VACUUM PACKAGING LIQUID CONTAINING FOODSTUFF

(76) Inventors: John Clare William Scott, The River House, Skippool Creek, Thornton-le-Fvide Nr. Blackpool FY5 5LF (GB); James Donoghue, 24 Newby Avenue, Fleetwood Lancashire FY7 8NJ (GB)

( * ) Notice: Subject to any disclaimer, the term of this patent is extended or adjusted under 35 U.S.C. 154(b) by 363 days.

(21) Appl. No.: 09/655,223

(22) Filed: Sep. 5, 2000

(51) Int. Cl.[7] ..... B65B 31/02

(52) U.S. Cl. ..... 426/404; 426/402; 426/399; 426/487

(58) Field of Search ..... 426/404, 487, 426/397, 399, 407, 402; 53/432–434

(56) References Cited

U.S. PATENT DOCUMENTS

| | | | | | |
|---|---|---|---|---|---|
| 602,315 | A | * | 4/1898 | Fernandez | 426/404 |
| 1,980,417 | A | * | 11/1934 | Malmquist | 426/404 |
| 1,980,695 | A | * | 11/1934 | Pork | 426/487 |
| 2,076,459 | A | * | 4/1937 | Hanson | 426/404 |
| 2,151,644 | A | * | 3/1939 | Stephens | 426/487 |
| 2,169,367 | A | * | 8/1939 | Mills | 426/404 |
| 2,286,999 | A | * | 6/1942 | Smith | 426/404 |
| 2,325,360 | A | * | 7/1943 | Ayers et al. | 426/399 |
| 2,331,895 | A | * | 10/1943 | Dunmire | 426/487 |
| 2,361,695 | A | * | 10/1944 | Lizeray | 426/404 |
| 2,411,896 | A | * | 12/1946 | Richmond et al. | 426/402 |
| 2,428,044 | A | * | 9/1947 | Sharp et al. | 426/487 |
| 2,471,170 | A | * | 5/1949 | Scott et al. | 426/402 |
| 2,517,569 | A | * | 8/1950 | Huzenlaub | 426/399 |
| 2,634,907 | A | * | 4/1953 | Smith | 426/487 |
| 2,870,027 | A | * | 1/1959 | Romero | 426/404 |
| 2,911,308 | A | * | 11/1959 | Smith et al. | 426/397 |
| 3,391,009 | A | * | 7/1968 | Fehlberg et al. | 426/487 |
| 3,984,580 | A | * | 10/1976 | Gur-Arieh | 426/404 |
| 3,987,209 | A | * | 10/1976 | Gatineau et al. | 426/407 |
| 4,259,360 | A | * | 3/1981 | Venetucci et al. | 426/487 |
| 4,291,085 | A | * | 9/1981 | Ito et al. | 426/412 |
| 4,300,923 | A | * | 11/1981 | Skoli et al. | 426/487 |
| 4,522,015 | A | * | 6/1985 | Hildebolt | 426/399 |
| 4,599,239 | A | * | 7/1986 | Wieland et al. | 426/487 |
| 4,867,994 | A | * | 9/1989 | Perrine | 426/399 |
| 5,006,354 | A | * | 4/1991 | Rahrooh et al. | 426/487 |
| 5,384,147 | A | | 1/1995 | Hilpert | |
| 5,457,939 | A | * | 10/1995 | Bardou et al. | 426/404 |
| 6,231,907 | B1 | * | 5/2001 | Kino et al. | 426/397 |

FOREIGN PATENT DOCUMENTS

| | | | |
|---|---|---|---|
| DE | 2615003 | * | 11/1977 |
| DE | 2700125 | * | 7/1978 |
| GB | 998 277 A | | 7/1965 |
| GB | 1 543 512 | | 4/1979 |
| JP | 56-021549 | * | 2/1981 |

* cited by examiner

*Primary Examiner*—Steven Weinstein
(74) *Attorney, Agent, or Firm*—Adams Evans P.A.

(57) ABSTRACT

The present invention provides a method of packaging goods having a liquid element, said liquid element comprising dissolved gases, wherein the liquid element is treated prior to the goods being subjected to a vacuum packing process, such that a substantial volume of the dissolved gages do not escape from said liquid element during said vacuum packing process. Suitable methods of treatment of the liquid element include subjecting the liquid element to a gas removal process and subjecting the liquid element to a freezing process.

5 Claims, No Drawings

METHOD FOR VACUUM PACKAGING LIQUID CONTAINING FOODSTUFF

FIELD OF THE INVENTION

The present invention relates to a method of packaging goods. In particular, but without limitation, the present invention relates to methods of vacuum packaging goods.

BACKGROUND OF THE INVENTION

Methods of vacuum packing food are well known. A basic vacuum packing process for packaging a foodstuff, for example coffee, comprises placing the foodstuff inside a plastic pouch, placing the pouch inside the cavity of a vacuum packer, and removing the air from the cavity by means of the vacuum pump. The pouch is then sealed whilst it remains in the evacuated cavity in order to maintain a vacuum inside the pouch. The shelf life of foodstuffs can be greatly enhanced by using this method of packaging.

It in also known to use gas flushing vacuum packing to pack foodstuffs. Gas flushing vacuum packing involves placing the foodstuff in a container and placing the container in the cavity of a vacuum packer. Again the cavity is evacuated by means of the vacuum pump of the packer. In this case though, before the container is sealed, the cavity of the vacuum packer is filled with an inert gas, for example, helium, argon, nitrogen or carbon dioxide or mixtures thereof. The amount of inert gas supplied to the cavity is generally sufficient to return the pressure inside the cavity to at or around atmospheric pressure, but this can be varied as required. The container is then sealed whilst in the inert gas atmosphere, thereby providing a sealed container in which the foodstuff is stored in an inert atmosphere. Gas flushing vacuum packing is often used to package fresh meat, for example, and is advantageous in that is can prolong the shelf life of refrigerated foodstuffs.

Whilst the aforementioned methods of packaging are advantageous for packaging solid goods, such as coffee or meat, ouch methods have not been found suitable for packaging goods comprising a liquid element. By "liquid element" we mean the portion of the goods which are in a liquid state and are separable from and not a component part or any solid element of the goods.

When goods having a liquid element are subjected to vacuum packing gases, dissolved in the liquid come out of solution, i.e. they form a gas, due to the reduction in pressure. This is a problem, in that in order to operate properly, and provide an airtight seal, it is important that the vacuum packer is kept clean. When the liquid boils, it tends to spray over the inside of the vacuum packer cavity and reduces the effectiveness of the packaging. Furthermore, the majority of the liquid is removed from the goods to be packaged.

It is an object of preferred embodiments of the present invention to provide an improved method of packaging goods.

SUMMARY OF THE INVENTION

The present invention provides a method of packaging foodstuffs having a liquid element and a solid element, said liquid element comprising dissolved gases, the method comprising the steps of: subjecting the liquid element to a gas removal process to remove a substantial proportion of the dissolved gases from the liquid element prior to said foodstuff being subjected to a vacuum packing process and before being combined with the solid element of the foodstuff in a single container for the vacuum packing process; and vacuum packing the combined liquid element and solid element; and in which no heat is applied to the liquid element during the packaging process.

Preferably, the liquid element is treated by subjecting it to a gas removal process.

Suitably, the gas removal process comprises subjecting the liquid to an evacuation process in a vacuum packer. Suitably, the liquid is placed in a container, which is placed in the cavity of a vacuum packer. The cavity is then evacuated in the conventional manner.

As the cavity is evacuated, any dissolved gases in the liquid come out of solution into the gaseous state and escape in the form of bubbles which burst allowing the gas to escape. When substantially all of the dissolved gases have been removed from the liquid the liquid stops bubbling.

Suitably, the gas removal process removes substantially all of the dissolved gases from the liquid.

The length of time taken to remove substantially all of the dissolved gases from the liquid will vary depending upon the composition of the liquid, the viscosity of the liquid, the volume of liquid and the exposed surface area of the liquid held in the container, amongst other things.

Because the escaping gases form bubbles the volume of the liquid increases during the gas removal process whilst the bubbles of gas escape. An the viscosity of the liquid increases, the size of the bubbles increases. Therefore, the volume of a viscous liquid will increase more during the gas removal process than would the volume of a less viscous liquid.

For liquid elements comprising a particularly viscous liquid which comprises a plurality of component liquids, for example a cream based sauce for food, it may be advantageous to subject the component parts of the liquid element to separate gas removal processes. For example, in the case of a cream based white wine sauce the white wine and the cream are advantageously subjected to separate gas removal processes before being combined together for the vacuum packing process.

Suitably, the container holding the liquid has a volume of at least twice, preferably at least three times, more preferably at least four times and most preferably at least five times, the volume of the liquid being subjected to the gas removal process.

Generally, the gas removal process requires evacuation of the cavity for a time of the order of seconds, for example for 20–30 seconds. However, it has been found that evacuation for a longer period is not detrimental to the nature and quality of the liquid. Evacuation until the liquid stops bubbling (to the naked eye) is considered to be the minimum period required.

In order to be certain that substantially all of the dissolved gases have been removed from the liquid, the liquid could be subjected to evacuation for an extended period, which extended period is longer than the minimum period. This extended period may be up to 120%, is suitably up to 130%, is preferably up to 150%, is more preferably up to 160% and is especially up to 200% or more of the minimum period.

Suitably, during the gag removal process, the cavity of the vacuum packer is evacuated to at least a 90% vacuum, preferably to at least a 95% vacuum, more preferably to at least a 99% vacuum and especially to at least a 99.5% vacuum.

It has been found that the gas removal process outlined above does not affect the flavor or consistency of the liquid element, and because no heat is applied to the liquid element, it remains uncooked during the gas removal process.

An alternative gas removal process, involves cooking the liquid element, for example, by heating to boiling point. However, this process is not preferred if the object is to provide a product comprising fresh, uncooked food. The quality of the sauce will be reduced by cooking before packaging followed by subsequent reheating for consumption.

As an alternative to a gas removal process the liquid element may be treated by subjecting it to a freezing process prior to the goods being subjected to a vacuum packing process.

Suitably, if the goods comprise a liquid element and a solid element, only the liquid element is subjected to freezing. However, both the liquid element and the solid element may be subjected to freezing before being subjected to the vacuum packing process.

Because the liquid element is in a solid form during the vacuum packing process, the dissolved gases in the liquid cannot leave solution and form a gas which escapes during the vacuum packing process. Therefore, the disadvantages of vacuum packing a liquid are avoided. The liquid element can be left to melt after packaging.

An advantage of treating the liquid element by freezing is that again, this process avoids cooking the liquid prior to packaging and thus avoids repeated cooking processes which impair the quality of the food.

Preferably, treatment of the liquid element does not involve cooking the liquid element.

The vacuum packing process of the inventive method may be any conventional vacuum packing process, including a basic vacuum packing process and a gas flushing vacuum packing process. For example, suitable basic vacuum packing and gas flushing vacuum packing processes are described above in the section entitled"Background of the Invention".

The goods packaged in accordance with the present invention may comprise substantially only a liquid element. For example, milk or sauces for food, such as pasta sauces, may be packaged in accordance with the present invention.

Alternatively, goods packaged in accordance with the present invention may comprise a liquid element and a solid element. For example, fresh pasta in a pasta sauce or meat in a sauce may be packaged in accordance with the present invention.

If the goods comprise a solid element and a liquid element, the liquid element is preferably treated before being combined with the solid element of the goods for the vacuum packing process.

In the case of foodstuffs, if the goods comprise a solid element, which solid element comprises a liquid intrinsic within its structure, for example a piece of meat, the solid element in suitably treated before vacuum packing such that the intrinsic liquid within the solid element can escape during cooking. Suitable methods of treating the solid element include perforating the solid element. Suitably, the surface at least of the solid element is perforated. Preferably, the solid element is perforated at a plurality of locations. The perforations may provide a plurality of small holes, through which the liquid can escape as it boils during the cooking process. Suitably, this series of holes is provided by a meat tenderizer as commonly used. Alternatively, any means of piercing the solid element may be used. If the said element is perforated at a plurality of locations, the perforations may be applied in a single or a plurality of perforating steps. This method of treating the solid element is particularly appropriate if the method of cooking involves microwave cooking.

Vacuum packing of goods finds particular advantage in packaging of foodstuffs. However, vacuum packing may find advantage in packaging of any goods which are subject to deterioration during prolonged storage periods.

When the liquid element which has been treated is subsequently subjected to a vacuum packing process, the liquid element does not boil. Thus, goods treated in accordance with preferred embodiments of the present invention can be packaged using conventional vacuum packing techniques without the disadvantages of the prior art.

The invention further provides a method of vacuum packing goods having a liquid element, comprising the steps of subjecting the liquid element to a gas removal process, followed by subjecting the goods to a vacuum packing process.

The gas removal process may be any suitable process as hereinbefore described.

The method may further comprise the step of perforating a solid element of said goods, before subjecting said goods to said vacuum packing process.

The perforating step may comprise piercing the surface at least of said solid element. The perforating step preferably comprises piercing the full depth of said solid element.

The perforating step may involve piercing the solid element in a plurality of locations. The solid element may be pierced in a plurality of locations in a single or a plurality of perforating steps.

The vacuum packing step may comprise any suitable vacuum packing process as hereinbefore described.

The present invention yet further provides a packaged foodstuff packaged in accordance with the method of the present invention.

The present invention finds particular advantage in packaging of fresh foodstuffs. An advantage of the present invention resides in the fact that fresh, uncooked foodstuffs can be packaged using conventional vacuum packing techniques to provide products which are ready for cooking by any method, including in a conventional oven, in a pressure cooker, by steaming and in a microwave oven. Also, because products of the present inventive method do not have to be cooked before packing, cooking the foods for consumption is the only cooking process to which the food is subjected. Therefore, the quality of the food product is improved because the food need only be subjected to a single cooking process rather than a cooking and separate reheating process.

Furthermore, if the liquid element has been subjected to a gas removal process as described above, when the product is cooked for consumption the liquid element does not boil as vigorously. This is particularly advantageous when using microwave cookery techniques. Also, this advantage is particularly evident for more viscous liquids, such as cream based sauces for food.

The present invention finds particular advantage in the provision of refrigerated foodstuffs, in particular for fresh, uncooked ready meals, having an extended shelf life.

DESCRIPTION OF PREFERRED EMBODIMENTS OF THE INVENTION

A sauce for meat is prepared by mixing, white wine, cream, cornflour and other flavourings. The sauce is placed in a container, which container has a volume of at least five times the volume of the sauce.

The container is placed in the cavity of a vacuum packer and the cavity is sealed. The vacuum pump is then turned on and the cavity is evacuated to a 99.5% vacuum. As the cavity is evacuated the sauce bubbles as the dissolved gases in the sauce come out of solution and form a gas, which bubbles burst so that the gases escape from the liquid. The evacuation process is carried out for about 40 seconds, which is until about 10 seconds after the liquid has stopped bubbling.

The container and the liquid is then removed from the cavity of the vacuum packer.

A proportion of the thus degased sauce is placed into a microwaveable plastic tray. A portion of fresh, uncooked chicken is then placed on top of the sauce. A further portion of the degased sauce in placed on top of the fresh, uncooked chicken.

The microwaveable plastic tray is then placed in the cavity of a vacuum packer. The cavity is evacuated, again to a 99.5% vacuum. A 70:30 wt % mixture of nitrogen:carbon dioxide gas is then supplied to the cavity of the vacuum packer to provide an inert gas atmosphere in the cavity. The gas mixture is supplied by BOC, England. Sufficient gas is supplied to produce a pressure of about atmospheric pressure in the cavity. The container is then sealed using a plastic film, whilst it remains in the cavity in the inert gas atmosphere. The container is sealed such that an air tight seal in created.

The thus packaged food is stored in a refrigerator until required for consumption. To cook the food, the package is removed from the refrigerator. The film is then pierced and the package is placed in a microwave oven for cooking. The cooked food may be removed from the container for serving.

Alternatively, the microwaveable plastic tray and the plastic film in which the food is packaged may be replaced by an oven proof container and film. The packaged food may then be cooked in a conventional oven.

Alternatively, the packaged food may be removed completely from the container before cooking.

Alternatively, the chicken may be perforated before placing in the microwaveable plastic tray with the sauce for vacuum packing.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention in not restricted to the details of the foregoing embodiments(s). The invention extends to any novel one, or any novel combination, of the features disclosed in thin specification (including any accompanying claims, abstract and drawings), or to any novel one, or any novel combination, of the steps of any method or process so disclosed.

What is claimed is:

1. A method of packaging foodstuffs having a liquid element and a solid element, said liquid element comprising dissolved gases, the method comprising the steps of:

placing said liquid element in a first container, said first container having a volume of at least twice the volume of said liquid element;

placing said first container, containing said liquid element, in a cavity of a vacuum packer;

evacuating said cavity containing said first container with said liquid element therein by means of a vacuum pump to remove a substantial proportion of the dissolved gases from the liquid element;

combining said evacuated, degassed liquid element with said solid element of the foodstuff in a second container for a vacuum packing process; and vacuum packing the combined liquid element and solid element in said second container;

wherein no heat is applied to the liquid element during the packaging process.

2. A method in accordance with claim 1 wherein the said gas removal process removes substantially all of the dissolved gases from the liquid element.

3. A method in accordance with claim 1 wherein said first container has a volume of at least three times the volume of said liquid element.

4. A method in accordance with claim 1 wherein said first container has a volume of at least four times the volume of said liquid element.

5. A method in accordance with claim 1 wherein said first container has a volume of at least five times the volume of said liquid element.

* * * * *